US011708783B1

(12) United States Patent
Corkery

(10) Patent No.: US 11,708,783 B1
(45) Date of Patent: Jul. 25, 2023

(54) CATALYTIC CONVERTER ANTI-THEFT DEVICE

(71) Applicant: Corkery Tractor Trailer, Inc., Canton, MA (US)

(72) Inventor: Robert James Corkery, Canton, MA (US)

(73) Assignee: Corkery Tractor Trailer, Inc., Canton, MA (US)

( * ) Notice: Subject to any disclaimer, the term of this patent is extended or adjusted under 35 U.S.C. 154(b) by 85 days.

(21) Appl. No.: 17/362,244

(22) Filed: Jun. 29, 2021

(51) Int. Cl.
*F01N 13/18* (2010.01)

(52) U.S. Cl.
CPC ..... *F01N 13/1894* (2013.01); *F01N 2260/22* (2013.01); *F01N 2450/24* (2013.01); *F01N 2590/08* (2013.01)

(58) Field of Classification Search
CPC ... F01N 2260/22; F01N 13/18; F01N 2260/20
See application file for complete search history.

(56) References Cited

U.S. PATENT DOCUMENTS 6,591,935 B1 * 7/2003 Petley ..... F01N 13/1811 285/253
7,971,676 B2 * 7/2011 Dusa, II ..... F01N 13/18 248/551
8,002,232 B2 8/2011 Meislahn
8,963,699 B2 * 2/2015 Potter ..... B60R 25/20 70/57.1
2009/0107752 A1 * 4/2009 Dusa, II ..... F01N 13/18 180/287
2010/0258703 A1 * 10/2010 Meislahn ..... F01N 13/1822 248/551
2011/0036130 A1 * 2/2011 Hisler ..... F01N 3/28 70/57.1
2011/0253471 A1 * 10/2011 Dusa, II ..... F01N 13/18 180/287
2013/0300550 A1 * 11/2013 Potter ..... B60R 25/20 340/429
2015/0123777 A1 * 5/2015 Potter ..... B60R 25/20 340/429
2015/0135692 A1 * 5/2015 Ramusch ..... F01N 13/1894 60/324
2016/0138243 A1 * 5/2016 Ogura ..... E02F 9/0866 180/309

OTHER PUBLICATIONS https://catclamp.com (last visited Jun. 30, 2021).

* cited by examiner

*Primary Examiner* — Anthony Ayala Delgado
(74) *Attorney, Agent, or Firm* — Prince Lobel Tye LLP

(57) ABSTRACT

Disclosed herein is a catalytic converter anti-theft device for motor vehicles. The anti-theft device a motor vehicle catalytic converter anti-theft device comprises a first shell component configured to surround, at least in part, a first portion of a motor vehicle catalytic converter. A second shell component is configured to surround, at least in part, a second portion of the motor vehicle catalytic converter. The first shell component and the second shell component are configured to be attachable to each other in coaxial relation about the first portion of the catalytic converter and the second portion of the catalytic converter, respectively. A distal end of at least the first shell component comprises a structure configured to prevent axial movement of the first shell component relative to the catalytic converter. At least the first shell component further may be attachable to a fixed component of the motor vehicle.

16 Claims, 4 Drawing Sheets

CATALYTIC CONVERTER ANTI-THEFT DEVICE

FIELD OF THE INVENTION

The present invention generally relates to the field of anti-theft devices, and more particularly to the field of motor vehicle catalytic converter anti-theft devices.

BACKGROUND OF THE INVENTION

Catalytic converters are prevalent in motor vehicle exhaust systems. In fact, motor vehicle air quality laws essentially require their use in motor vehicles with internal combustion engines. In simple terms, catalytic converters operate by passing exhaust gasses past a network of certain metals (i.e., catalysts) that facilitate chemical reactions between compounds in the gasses and air. The intended result is the reduction of noxious chemical compounds such as nitrous oxides and incompletely oxidized hydrocarbons such as carbon monoxide. Because of the hostile environment in which these chemical reactions take place, the catalysts are most frequently noble metals such as platinum, palladium, and rhodium, which are chosen because of their ability to both catalyze harmful compounds and to do so over an extended period of time in such a harsh environment.

Noble metals are also economically valuable, and catalytic converters are usually, if not almost always, connected to the underside of motor vehicles as part of exhaust systems that are accessible to potential thieves. This makes them tempting targets for criminals, and in fact, theft of catalytic converters is currently a growing problem. It is a problem because not only must stolen catalytic converters be replaced with resulting economic impact, but the motor vehicles they are stolen from often cannot be used until they are, which may result in further economic hardship for the affected vehicle owner. As a result, several attempts have been made to address these problems by preventing theft of catalytic converters, or at least by making such theft less economically palatable.

U.S. Pat. No. 8,002,232 discloses a catalytic converter theft deterrence device comprising at least four adjustable plates configured to be fastened directly to a catalytic converter and also secured to an automobile frame with a looped cable.

U.S. Pat. No. 8,963,699 discloses a catalytic converter theft protection arrangement comprising, inter alia, a metal cage rigidly attached to an underside of a vehicle substantially surrounding the catalytic converter. The arrangement may also comprise an alarm system.

The inventor of the present invention has experienced theft of catalytic converters from heavy duty vehicles such as trucks and busses. As opposed to passenger cars, catalytic converters connected to exhaust systems of trucks and busses are easier to access, and these vehicles are often parked close together in lots that may not be well guarded, making them particularly appealing targets for nighttime theft. In response, the inventor has devised a catalytic converter anti-theft device capable of deterring theft of catalytic converts from motor vehicles, and particularly from heavy duty motor vehicles, which is believed to be a shortcoming of presently available catalytic converter theft deterrence devices.

SUMMARY OF THE INVENTION

To address the aforementioned problem of catalytic convert theft, the present invention is directed to catalytic converter anti-theft devices for motor vehicles.

In a first non-limiting embodiment of the present invention, a motor vehicle catalytic converter anti-theft device comprises a first shell component configured to surround, at least in part, a first portion of a motor vehicle catalytic converter. A second shell component is configured to surround, at least in part, a second portion of the motor vehicle catalytic converter. The first shell component and the second shell component are configured to be attachable to each other in coaxial relation about the first portion of the catalytic converter and the second portion of the catalytic converter, respectively. A distal end of at least the first shell component comprises a structure configured to prevent axial movement of the first shell component relative to the catalytic converter. At least the first shell component further may be attachable to a fixed component of the motor vehicle, such as the vehicle's chassis or frame.

In a second non-limiting embodiment of the present invention, a motor vehicle catalytic converter anti-theft device comprises a first substantially tubular shell component configured to surround, at least in part, a first portion of a motor vehicle catalytic converter. A second substantially tubular shell component is configured to surround, at least in part, a second portion of the motor vehicle catalytic converter. The first substantially tubular shell component and the second substantially tubular shell component are attachable to each other in coaxial relation about the first portion of the catalytic converter and the second portion of the catalytic converter, respectively. A distal end of the first substantially tubular shell component comprises a structure configured to prevent axial movement of the first substantially tubular shell component relative to the catalytic converter. At least the first substantially tubular shell component further may be attachable to a fixed component of the motor vehicle, such as the vehicle's chassis or frame.

In a third non-limiting embodiment of the present invention, a motor vehicle catalytic converter anti-theft device comprises a first shell component positioned to surround, at least in part, a first portion of a motor vehicle catalytic converter. A second shell component is positioned to surround, at least in part, a second portion of the motor vehicle catalytic converter. The first shell component and the second shell component are attached to each other in coaxial relation about the first portion of the catalytic converter and the second portion of the catalytic converter, respectively. The first shell component and the second shell component are spaced apart from each other in coaxial relation about the first portion of the catalytic converter and the second portion of the catalytic converter, respectively, via at least one spacer bar. A distal end of at least the first shell component comprises a structure configured to prevent axial movement of the first shell component relative to the catalytic converter. At least the first shell component further is attached to a fixed component of the motor vehicle, such as the vehicle's chassis or frame. At least the first shell component further may comprise an anti-tampering feature located proximate to one end of the means for attaching the first shell component and the second shell component.

DETAILED DESCRIPTION OF THE INVENTION

Figure 1:
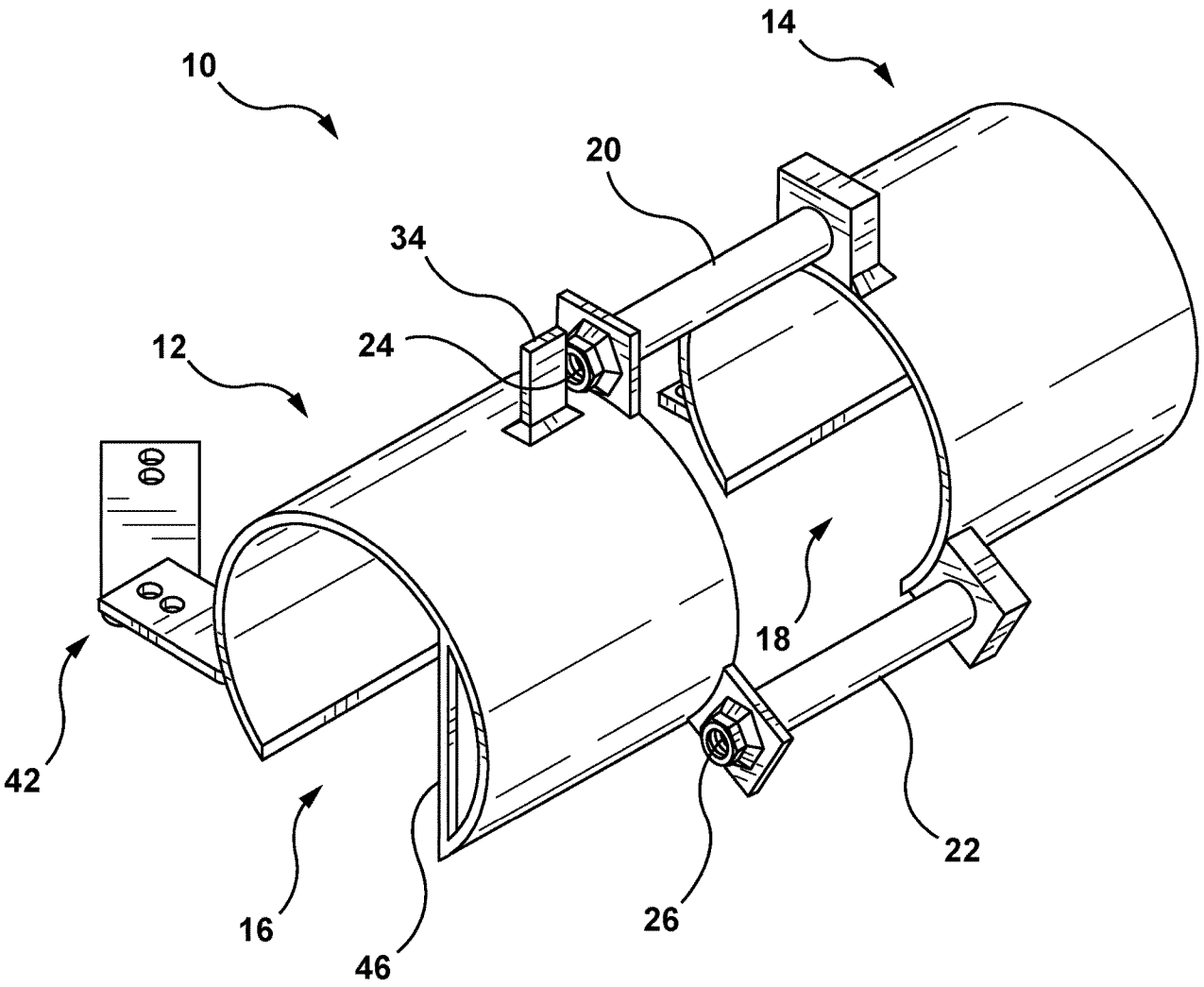
FIG. 1 is perspective view of the catalytic converter anti-theft device of the present invention.

Reference will now be made in detail to various non-limiting embodiments of a motor vehicle anti-theft device. It should be understood that other non-limiting embodiments, modifications, and equivalents will be evident to those skilled in the art in view of the non-limiting embodiments disclosed herein and that these natural variants should be considered to be within the scope of the appended claims.

It is to be further expressly understood that the motor vehicle anti-theft device described below is merely an illustrative embodiment of the present invention. Thus, the description that follows is intended to be only a description of illustrative examples of the present invention. The description is not intended to define the scope or set forth the bounds of the present invention, which are set forth in the appended claims.

Referring to FIG. 1-4, there is depicted a catalytic converter anti-theft device 10 according to a first embodiment of the present invention. The device 10 comprises a first shell component 12 and a second shell component 14. Although first and second shell components 12, 14 of the first embodiment are depicted as substantially tubular so as to conform to catalytic converter 32 (FIGS. 2 and 4), first and second shell components 12, 14 need not be tubular, but rather may be configured to conform more closely to the shape of a differently shaped catalytic converter to be protected by device 10. For example, first and second shell components 12, 14 may have substantially ovoidal or rounded rectangular cross-sections corresponding to catalytic converters having substantially ovoidal or rounded rectangular shaped cross-sections, as is known in the art. Wall thicknesses of first and second shell components 12, 14 should be sufficiently thick to make attempts at defeating anti-theft device 10 by cutting or sawing either or both of first and second shell components 12, 14 impractical and inconvenient for a would-be thief, but not so thick as to compromise effective heat dissipation or add excessive weight to the vehicle. In a preferred embodiment, wall thicknesses of first and second shell components are ¼ inch, which the inventor believes is optimal for use in a heavy-duty motor vehicle such as a truck or bus.

Again with respect to the Figures, first and second shell components 12, 14 are also depicted as comprising longitudinal axial slots 16, 18, the purpose of which is to facilitate heat dissipation from the catalytic converter 32. As such, slots 16, 18 may be wider or narrower than depicted in the Figures, depending on the particular catalytic converter being protected. However, slots 16, 18 preferably should be narrower than a narrowest transverse cross-sectional dimension of the particular catalytic converter being protected in order to prevent removal of the catalytic converter through the slots 16, 18.

Figure 2:
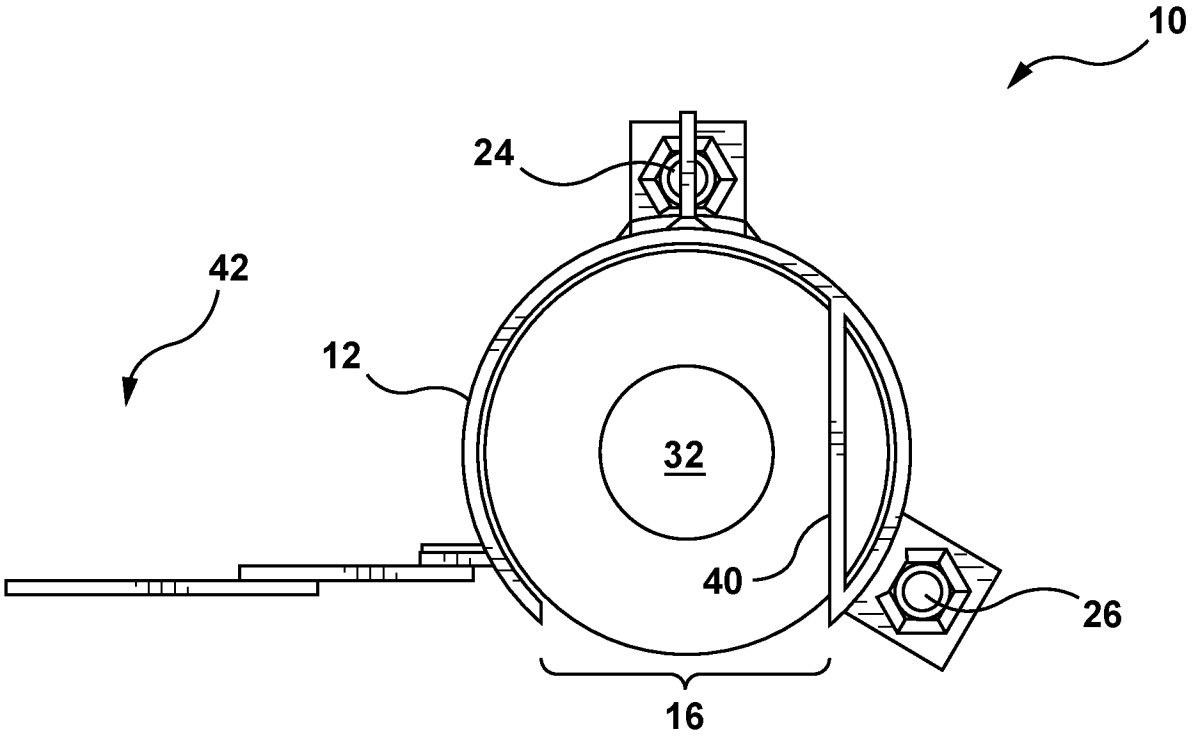
FIG. 2 is a perspective view of one end of the catalytic converter anti-theft device of FIG. 1 positioned about a catalytic converter.
Figure 3:
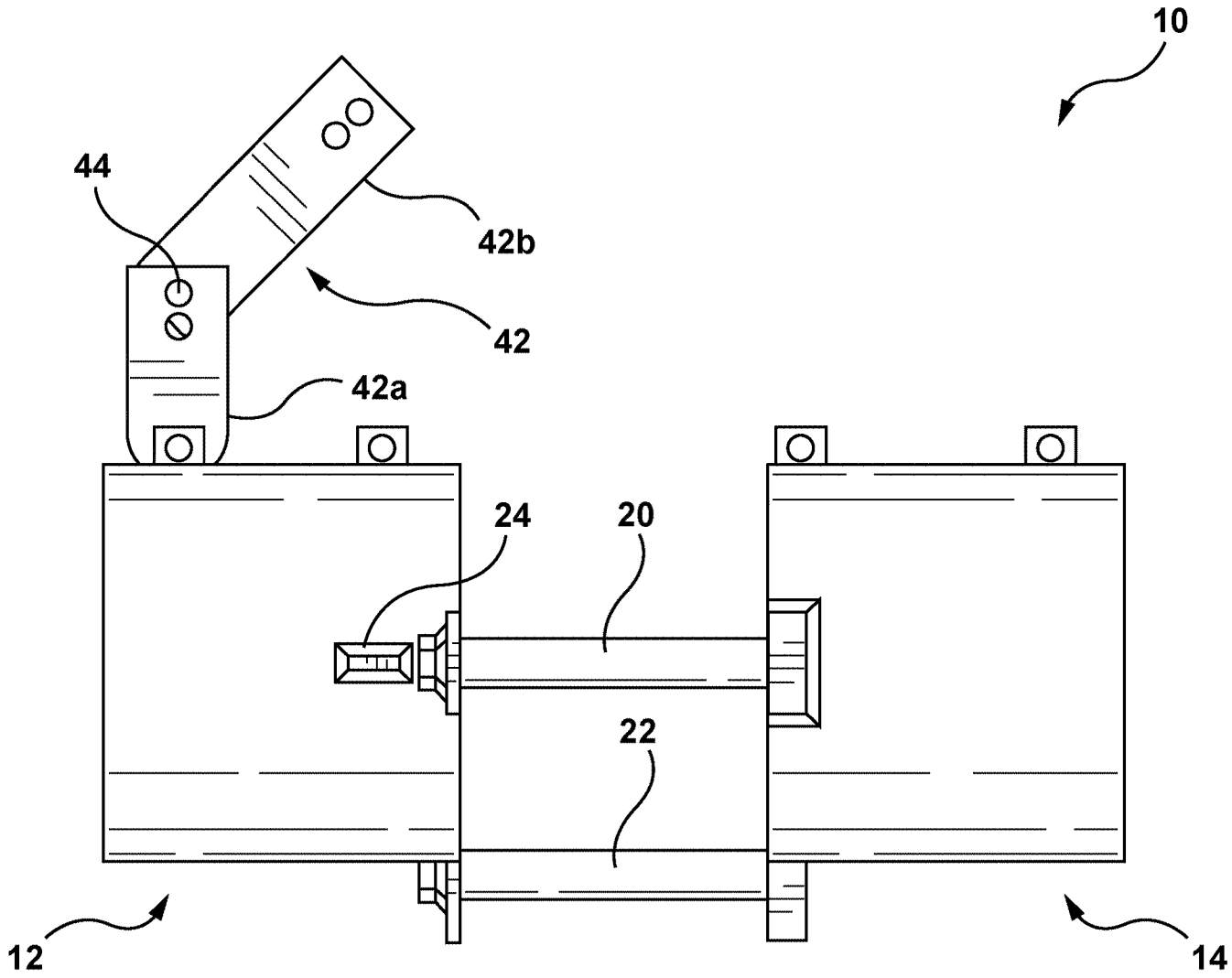
FIG. 3 is a perspective view from the top of catalytic converter anti-theft device of FIGS. 1 and 2.

As best depicted in FIG. 2, the inner diameters of first and second shell components 12, 14 preferably should be larger than the largest outer diameter of the catalytic converter 32 to further facilitate heat dissipation from the catalytic converter 32. However, it is envisioned that at least some contact between the inner surface of either or both of first and second shell components 12, 14 and the outer surface of the catalytic converter 32 may occur without unduly affecting heat dissipation.

Referring back to the Figures, the anti-theft device 10 of the preferred embodiment of the invention further comprises bolts 24, 26 (and corresponding nuts, not numbered) connecting first and second shell components 12, 14 together along a longitudinal axis of anti-theft device 10. While FIG. 1 shows two bolts 24, 26 according to the preferred embodiment, the present invention is not limited to two bolts, but may comprise at least one bolt, e.g., bolt 24, or more than two bolts 24, 26. In addition, the invention is not limited to the use of bolts 24, 26 to connect first and second shell components 12, 14, but may instead comprise other means for attaching first and second shell components 12, 14 to one another. For example, cables/clamps or bar stock/pins could replace bolts 24, 26 to achieve the same effect of connecting first and second shell components 12, 14.

At least a portion of the shanks of bolts 24, 26 are encased within spacer bars 20, 22. The lengths of spacer bars 20, 22 (and bolts 24, 26) may vary depending on the length of a particular catalytic converter being protected by anti-theft device 10, the operative principle being to maximize heat dissipation from the catalytic converter while minimizing the ability of a potential thief to defeat anti-theft device 10. In a preferred embodiment, the length of spacer bars 20, 22 is 6 inches. The wall thickness of spacer bars 20, 22 should be enough to deter a potential thief from cutting through spacer bars 20, 22 (and bolts 24, 26) without undue effort. In a preferred embodiment, spacer bars 20, 22 comprise stainless steel pipes having 1-inch outer diameters and 0.125-inch wall thicknesses. Of course, spacer bars 20, 22 may be other than pipe stock, depending on the means used to connect first and second shell components 12, 14 to each other. For example, if the connection means is square bar stock, spacer bars 20, 22 may comprise square tube stock correspondingly dimensioned to encase the square bar stock between first and second shell components 12, 14.

Figure 4:
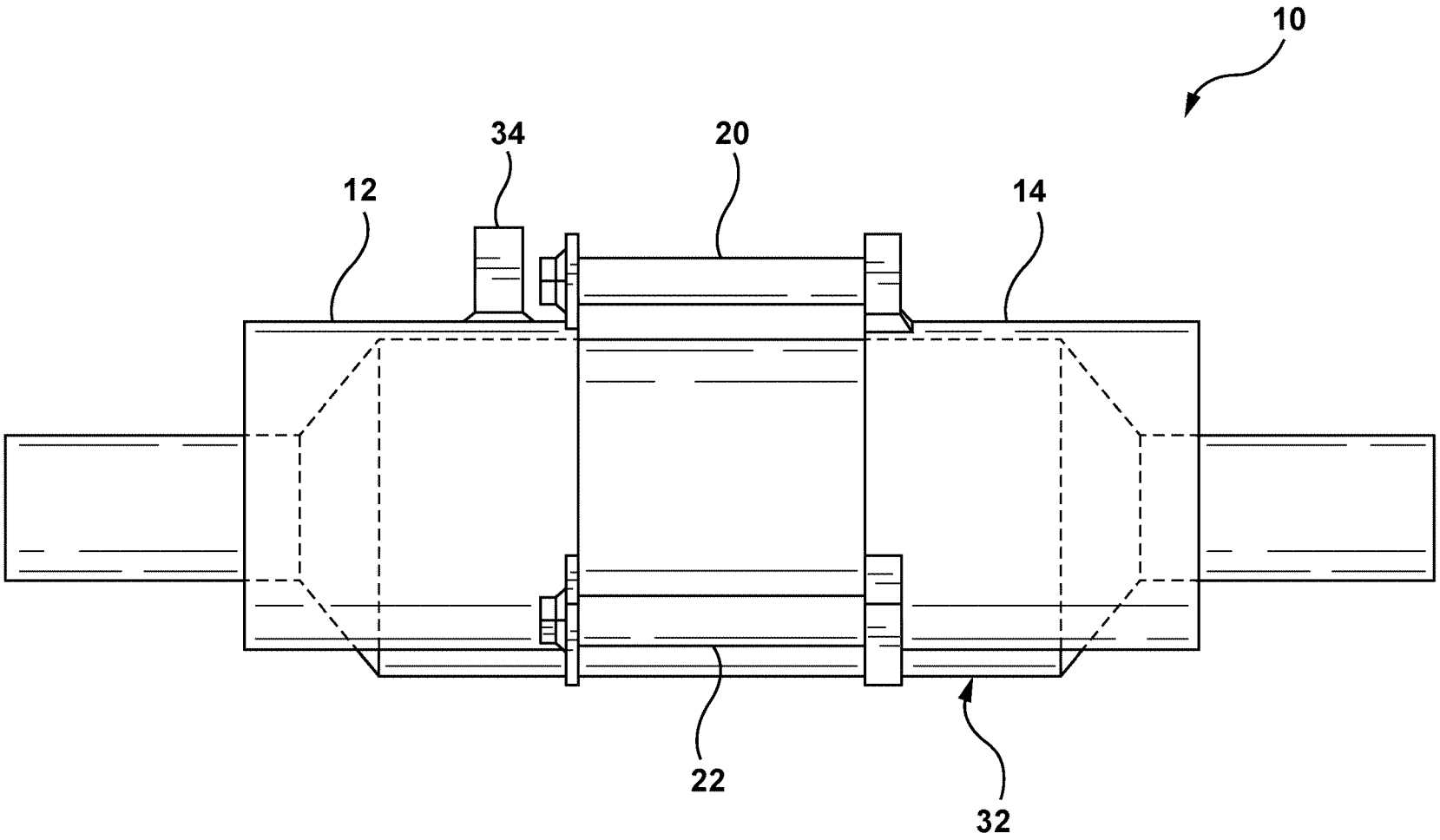
FIG. 4 is a side perspective view of the catalytic converter anti-theft device and catalytic converter of FIGS. 1-3 positioned about a catalytic converter.

Additionally, in alternative embodiments an anti-tampering feature 34 may be incorporated proximate and in linear axial arrangement to one or both ends of either or both bolts 24, 26 (or like attachment means). In the preferred embodiment the anti-tampering feature 34 may comprise a rectangular tab 34, as best seen in FIGS. 1 and 4. As one of ordinary skill would appreciate, the anti-tampering feature is situated to interfere with a potential thief attempting to unscrew a nut from bolt 24 and/or 26 in order to disconnect first and second shell components 12, 14. Of course, such a person of ordinary skill will appreciate that the anti-tampering feature 34 may be other than a tab 34, as long as the operative principle of discouraging an unauthorized person from unscrewing a nut from either or both bolts 24 and/or 26 by providing a physical impediment thereto.

As best seen in FIGS. 1 and 2, the distal ends of first and second shell components 12, 14 comprise a structure 40 affixed to the inner walls of first and second shell components 12, 14 to prevent axial translation of the anti-theft device 10 with respect to the catalytic converter 32 (i.e., to slide the device 10 away from catalytic converter 32 in a coaxial direction). Although only one structure 40 is depicted in the Drawings, those of skill in the art would appreciate that a second structure (not shown) could similarly be positioned at the distal end of second shell component 14. While the drawings depict the structure 40 of the preferred embodiment as a bar, the ends of which are connected to the first shell component 12 at two points, the invention is not so limited, the operative principle being to have at least one structure positioned at a distal end of both first and second shell components 12, 14 to prevent axial translation of the anti-theft device 10 with respect to the catalytic converter 32. For example, the structure 40 may comprise a round bar, a pipe, or a tab cantilevered from the inner wall surface of the first shell component 12 (and/or second shell component 14), or connected to the inner wall surface of the first shell component 12 (and/or second shell component 14) at more than two places. The thickness of the structure 40 should be sufficient to deter a potential thief from cutting same or otherwise defeating anti-theft device 10 by lateral translation of same with respect to the catalytic converter 32, while not unduly affecting heat dissipation from the catalytic converter 32. In a preferred embodiment, structures 40 are 0.25 inches thick bar stock.

At least one pivot assembly 42 may be connectable to either of first or second shell components 12, 14 to allow the anti-theft device 10 to be connected to a fixed component of the vehicle (e.g., part of the vehicle chassis or frame). In a preferred embodiment, the anti-theft device 10 may comprise at least two pivot assemblies 42, one (or more) for each of first and second shell components 12, 14. In the drawings, pivot assembly 42 of the preferred embodiment is depicted as comprising two bars 42*a*, 42*b* with a plurality of bolt holes 44 to facilitate connecting the anti-theft device to fixed components of different vehicles, but other embodiments may have more or fewer bars and/or alternative bold holes 44, depending on the particular vehicle to which the anti-theft device 10 is to be attached.

Various embodiments having been thus described in detail by way of example, it will be apparent to those of skill in the art that variations and modifications may be made without departing from the spirit and scope of the invention. The invention includes all such variations and modifications as fall within the scope of the appended claims. As such, the described non-limiting embodiments ought to be considered to be merely illustrative of some of the more prominent features and applications. Other beneficial results may be realized by applying the non-limiting embodiments in a different manner or modifying them in ways known to those familiar with the art. This includes the mixing and matching of features, elements and/or functions between various non-limiting embodiments, which is expressly contemplated herein so that one of ordinary skill in the art would appreciate from this disclosure that features, elements and/or functions of one embodiment may be incorporated into another embodiment as appropriate, unless described otherwise, above. Although the description is made for particular arrangements and methods, the intent and concept thereof may be suitable and applicable to other arrangements and applications.

The invention claimed is:

1. A catalytic converter anti-theft device for a motor vehicle comprising:

a first shell component configured to surround, at least in part, a first portion of a catalytic converter;

a second shell component configured to surround, at least in part, a second portion of the catalytic converter;

wherein the first shell component and the second shell component are configured to be attachable to each other in coaxial relation about the first portion of the catalytic converter and the second portion of the catalytic converter, respectively;

a distal end of at least the first shell component comprises a structure configured to prevent axial movement of the first shell component relative to the catalytic converter;

wherein the first shell component and the second shell component are attachable to each other by at least one attachment means disposed between and attachable to both the first shell component and the second shell component; and at least one spacer bar configured to substantially circumferentially surround a length of the at least one attachment means disposable between and attachable to both the first shell component and the second shell component.

2. A catalytic converter anti-theft device according to claim 1, further comprising:

at least the first shell component comprises a slot positioned along the longitudinal axis of the first shell component.

3. A catalytic converter anti-theft device according to claim 2, further comprising:

at least the first shell component is further attachable to a fixed component of the motor vehicle.

4. A catalytic converter anti-theft device according to claim 3, further comprising:

the second shell component is separately attachable to a fixed component of the motor vehicle.

5. A catalytic converter anti-theft device according to claim 4, further comprising:

an anti-tampering feature on an outer surface of at least the first shell component.

6. A catalytic converter anti-theft device according to claim 5, further comprising:

a pivot assembly attachable to the first shell component at a first end of the pivot assembly, and attachable to a fixed component of the motor vehicle at the other end of the pivot assembly.

7. A catalytic converter anti-theft device according to claim 6, further comprising:

the structure configured to prevent axial movement of the first shell component relative to the catalytic converter is a bar attached to the first shell component.

8. A catalytic converter anti-theft device for a motor vehicle comprising:

a first substantially tubular shell component configured to surround, at least in part, a first portion of a catalytic converter;

a second substantially tubular shell component configured to surround, at least in part, a second portion of the catalytic converter;

wherein the first substantially tubular shell component and the second substantially tubular shell component are configured to be attachable to each other in coaxial relation about the first portion of the catalytic converter and the second portion of the catalytic converter, respectively; and a distal end of at least the first substantially tubular shell component comprises a structure configured to prevent axial movement of the first substantially tubular shell component relative to the catalytic converter;

wherein the first substantially tubular shell component and the second substantially tubular shell component are attachable to each other by at least one attachment means disposed between and attached to both the first substantially tubular shell component and the second substantially tubular shell component; and at least one spacer bar circumferentially surrounding a length of the at least one attachment means disposable between and attachable to both the first substantially tubular shell component and the second substantially tubular shell component.

9. A catalytic converter anti-theft device according to claim 8, further comprising:

at least the first substantially tubular shell component comprises a slot positioned along the longitudinal axis of the first substantially tubular shell component.

10. A catalytic converter anti-theft device according to claim 9, further comprising:

at least the first substantially tubular shell component is further attachable to a fixed component of the motor vehicle.

11. A catalytic converter anti-theft device according to claim 10, further comprising:

the second substantially tubular shell component is separately attachable to a fixed component of the motor vehicle.

12. A catalytic converter anti-theft device according to claim 11, further comprising:

an anti-tampering feature on an outer surface of at least the first substantially tubular shell component.

13. A catalytic converter anti-theft device according to claim 12, further comprising:

a pivot assembly attachable to the first substantially tubular shell component at a first end of the pivot assembly, and attachable to a fixed component of the motor vehicle at the other end of the pivot assembly.

14. A catalytic converter anti-theft device according to claim 13, further comprising:

the structure configured to prevent axial movement of the first substantially tubular shell component relative to the catalytic converter is a bar attached to the first substantially tubular shell component.

15. A catalytic converter anti-theft device for a motor vehicle comprising:

a first substantially tubular shell component configured to surround, at least in part, a first portion of a catalytic converter;

the first substantially tubular shell component comprises a slot positioned along the longitudinal axis of the first substantially tubular shell component;

a second substantially tubular shell component configured to surround, at least in part, a second portion of the catalytic converter;

the second substantially tubular shell component comprises a slot positioned along the longitudinal axis of the second substantially tubular shell component;

wherein the first substantially tubular shell component and the second substantially tubular shell component are configured to be attachable to each other in coaxial relation about the first portion of the catalytic converter and the second portion of the catalytic converter, respectively;

a distal end of the first substantially tubular shell component comprises a structure configured to prevent axial movement of the first substantially tubular shell component relative to the catalytic converter; and a distal end of the second substantially tubular shell component comprises a structure configured to prevent axial movement of the second substantially tubular shell component relative to the catalytic converter.

16. A catalytic converter anti-theft device according to claim 15, further comprising:

the structure configured to prevent axial movement of the first substantially tubular shell component relative to the catalytic converter is a bar attached to the first substantially tubular shell component.

* * * * *